United States Patent [19]

Santos

[11] Patent Number: 5,072,927

[45] Date of Patent: Dec. 17, 1991

[54] HAND EXERCISE DEVICE

[76] Inventor: James P. Santos, 223 Rockingstone Ave., Larchmont, N.Y. 10538

[21] Appl. No.: 631,742

[22] Filed: Dec. 20, 1990

Related U.S. Application Data

[63] Continuation of Ser. No. 369,013, Jun. 20, 1989, abandoned.

[51] Int. Cl.[5] ..... A63B 21/05; A63B 23/16

[52] U.S. Cl. ..... 272/68; 272/67; 272/141

[58] Field of Search ..... 272/67–68, 272/141, DIG. 5; 128/77

[56] References Cited

U.S. PATENT DOCUMENTS

| | | | |
|---|---|---|---|
| 468,154 | 2/1892 | McClure | 272/DIG. 5 X |
| 630,741 | 8/1899 | Robinson | 272/67 |
| 677,824 | 7/1901 | Troxler | 272/68 |
| 938,348 | 10/1909 | Stull | 272/68 |
| 1,623,869 | 4/1926 | Giraldi | 272/68 |
| 1,877,218 | 9/1932 | Blank | 272/137 |
| 2,806,699 | 12/1955 | Spooner | 272/DIG. 5 X |
| 2,926,911 | 3/1980 | Reichel | 272/68 |
| 3,129,939 | 4/1964 | Stock | 272/68 |
| 3,216,259 | 11/1965 | Bendix | 272/68 |
| 3,349,621 | 10/1967 | Mullen | 73/380 |
| 3,570,849 | 3/1971 | Ratchford | 272/68 |
| 3,672,219 | 6/1972 | Van Patten | 73/379 |
| 3,807,729 | 4/1974 | Sigma | 272/68 |
| 4,104,918 | 8/1978 | Macouearu et al. | 272/67 X |
| 4,226,412 | 10/1980 | Panepinto | 272/68 |
| 4,553,746 | 11/1985 | Lee | 272/68 |
| 4,558,864 | 12/1985 | Medwedeff | 272/68 X |
| 4,632,383 | 12/1986 | Tsuzuki | 272/DIG. 5 X |
| 4,684,125 | 8/1987 | Lantz | 272/130 |
| 4,783,067 | 11/1988 | Palmer | 272/68 |
| 4,824,103 | 4/1989 | Smidt | 272/DIG. 5 X |

*Primary Examiner*—David J. Isabella
*Assistant Examiner*—David H. Willse
*Attorney, Agent, or Firm*—Hopgood, Calimafde, Kalil, Blaustein & Judlowe

[57] ABSTRACT

A hand exercising device which facilitates the exercise for physical rehabilitation of a human hand. The present invention provides a hand exercising device which may be adjusted so as to accommodate hands of varying sizes. A moveable fulcrum is also provided which enables the user to vary the tension exerted by the device and, thereby, achieve the progressive exercise and strengthening of a hand. In a particular embodiment of the invention, there is provided an apparatus for the exercise of the hand and forearm comprising: a tension arm adapted for compression and extension exercise strokes, a translatable fulcrum for controlling the stiffness of the tension arm, adjustable grips which accommodate grasping of the device by a hand of a selected size and measuring apparatus for computing and recording the compressive forces exerted by the hand.

11 Claims, 3 Drawing Sheets

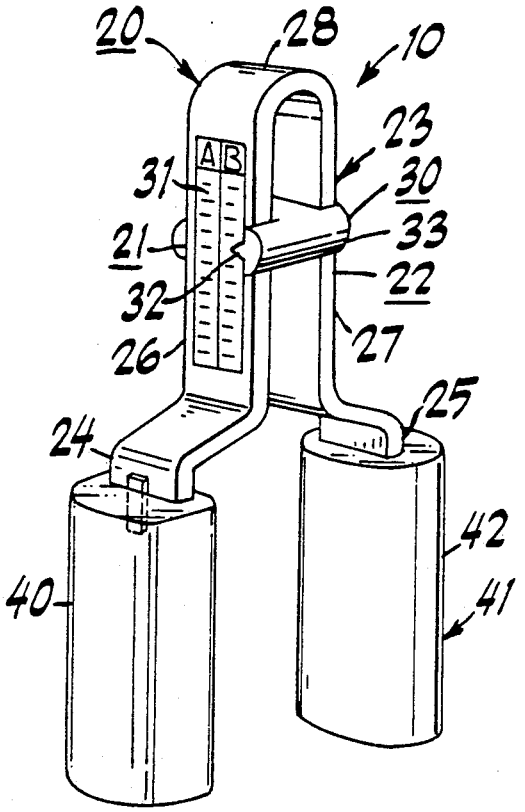
FIG. 1
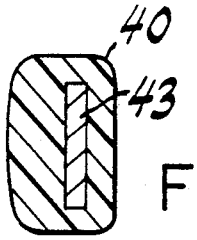
FIG. 7
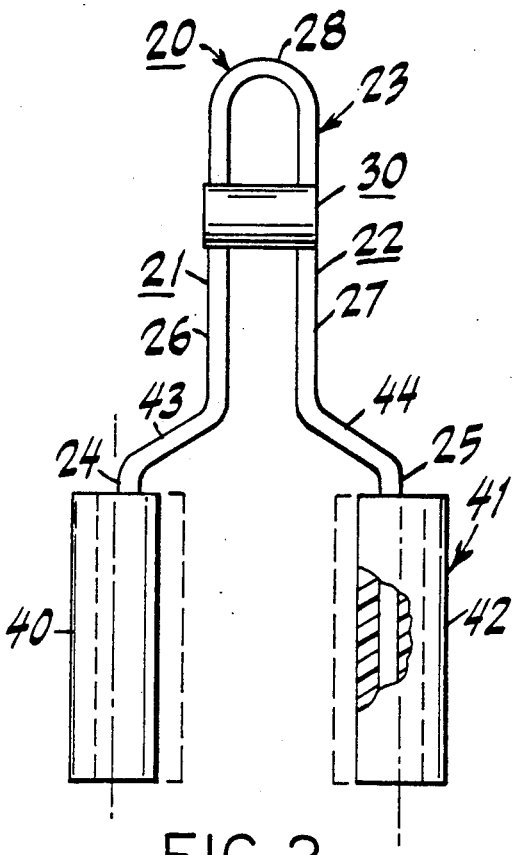
FIG. 2
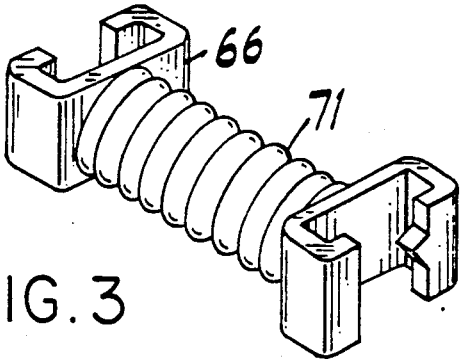
FIG. 3
FIG. 9
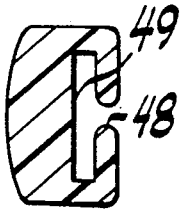

HAND EXERCISE DEVICE

This application is a continuation of application Ser. No. 369,013, filed June 20, 1989, now abandoned.

BACKGROUND OF THE INVENTION

The invention relates generally to the field of exercise devices. More specifically, the invention relates to hand-held exercise devices of the type used to strengthen the hand and forearm.

For the exercise of the hand and forearm, it is common practice to use an exercise grip. Such exercise grips commonly take the form of a pair of grip arms suspended at an angle from each other and joined at a common end by a coil or spring mechanism which exerts a resistive force when the grip arms are moved towards one another. In operation, the grip arms are grasped and squeezed, compressing the coil and thereby moving the grip arms toward each other for each exercise stoke. Upon release of the grip arms, the coil causes the grip arms to extend to their original or starting position.

Other exercise devices comprise a pair of frames slidably disposed with one another and having a spring mechanism connecting an end of each frame one to the other. When one end of a frame and the adjacent end of the other frame are grasped by a hand and pulled towards each other, the spring exerts a resistive force upon the user's hand.

For the progressive strengthening of a hand, a number of separate exercise grips are needed, each having a different stiffness for each degree of hand strength to be achieved. In addition, to accommodate the exercise of both large and small hands, different sized devices must be made available to accommodate each hand size. Unfortunately, the necessity of providing many different devices of various sizes and strengths is costly to the consumer.

In addition, for the physical rehabilitation of a hand, such exercise devices are not capable of measuring the compressive force exerted by a patient's hand or recording the patient's progress during rehabilitation.

Accordingly, it is an object of the present invention to provide a cost effective exercise apparatus which facilitates the development of hand and forearm muscles.

It is a further object of the present invention to provide a comfortable exercising apparatus which may be adjusted for use by hands of varying sizes.

It is still another object of the present invention to provide a variable resistance exercise apparatus which permits the measurement and display of the compressive forces exerted by a hand.

SUMMARY OF THE INVENTION

The present invention provides a hand exercising device which may be adjusted so as to accommodate hands of varying sizes. A moveable fulcrum is provided which enables the user to vary the tension exerted by the device and, thereby, achieve the progressive exercise and strengthening of a hand. In a particular embodiment of the invention, there is provided an apparatus for the exercise of the hand and forearm comprising: a tension arm adapted for compression and extension exercise strokes, a translatable fulcrum for controlling the stiffness of the tension arm, adjustable grips which accommodate grasping of the device by a hand of a selected size and measuring apparatus for computing and recording the compressive forces exerted by the hand.

BRIEF DESCRIPTION OF THE DRAWINGS

In the accomplishment of the above and to such other objects as may hereinafter appear, the present invention relates to a hand exercising device substantially as defined in the appended claims and as described in the following specification, as considered with the accompanying drawings in which:

FIG. 1 is a perspective view depicting the hand exercising apparatus of the present invention;

FIG. 2 is a side view of the apparatus of FIG. 1;

FIG. 3 is a perspective view of a translatable spring fulcrum of the present invention;

FIG. 7 is a sectional view of a grip for use with the apparatus of the present invention;

FIG. 9 is a sectional view of a grip for use with the apparatus shown in FIG. 6.

DETAILED DESCRIPTION OF THE DRAWINGS

Figure 4:
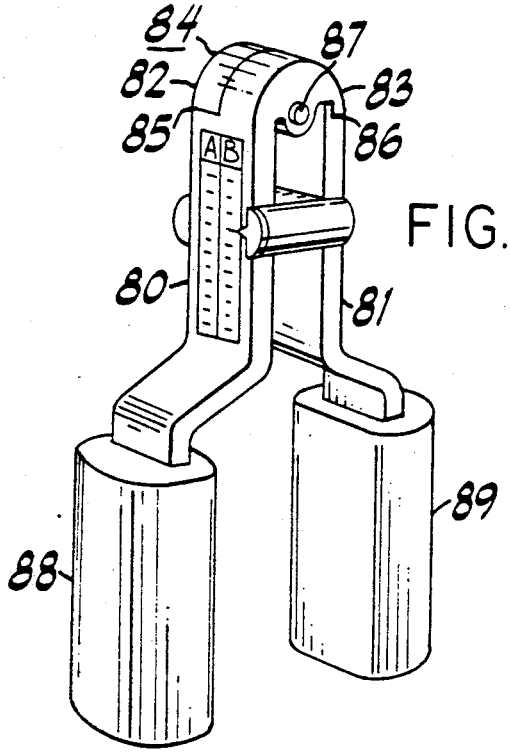
FIG. 4 is a perspective view of an alternative embodiment of the present invention.

Referring now specifically to the accompanying drawings, wherein like numerals designate similar parts throughout the various views, attention is directed first to FIG. 1 wherein the apparatus of the present invention is designated generally by reference number 10. More specifically, apparatus 10 comprises a tension arm 20 having a translatable fulcrum 30 and grips 40 and 42.

As shown in FIGS. 1 and 2, the tension arm 20 is generally U-shaped and comprises a first leg portion 21 and a second leg portion 22. The tension arm also includes a bend 28, for example 180 degrees, at its midsection so as to align first and second leg portions 21 and 22 in parallel with each other. Each leg portion is configured generally in the shape of an S, each arm of the S being oriented so as to mirror a corresponding portion of the other leg. Tension arm 20 thereby forms two U-shaped sections; a compression section 23 and a grip section 41.

The grip section comprises a pair of parallel arms 24 and 25, respectively, having end portions mounting adjustable grips 40 and 42. The compression section consists of a pair of arms 26 and 27, respectively, with a translatable fulcrum 30 mounted between the arms in a manner which provides for sliding engagement therewith. Fulcrum 30 shortens the moment arm between the fulcrum and the grips and multiplies the tension exerted when the grips are grasped and moved towards each other.

As best seen in FIG. 2, the grips are removeably mounted onto the end portions such that the tension arms pass through the interior of the grips but are offset a distance from the central axis of each grip. As best seen in FIG. 7, a slot 43 is located along the central axis of each grip 40 and 42 that permits them to slide onto each leg portion. The shoulders 43 and 44 at the bend of the S of each leg act as stops upon mounting the grips to the legs.

The distance between the outside edges of the grips when mounted to the tension arm can then be varied in order to accommodate different sized hands. This may be done by removing the grips and reversing their positions relative to one another. To adjust the device for use by a small hand, for example, each grip is mounted to arms 24 and 25 so that the edge of the grip at the greatest distance from the slot faces inward, as shown by dashed lines in FIG. 2.

To position the grips for use by a medium sized hand, one grip may be mounted so that the edge at the greatest distance from the slot faces outward from the device, as shown by either grip in solid lines. The other grip is then reversed so that the edge at the greatest distance from the slot faces inward, as shown by either grip in dashed lines.

To adjust the device for use by a large hand, each grip may be positioned so that the edge which is at the greatest distance from the slot faces outward from the device, shown in solid lines in FIG. 2.

Each grip consists of a suitable resilient material such as closed cell rubber or polymer foam in order to maintain comfort and prevent the circulation of blood in the user's hand from being cut off when the tension arms are grasped and squeezed tightly together. By using a resilient material, the grips effectively assume the profile of the fingers or palm without undo stress on the user's hand.

As best seen in FIG. 1, the translatable fulcrum is generally I-shaped, both end or T-portions 33 of the fulcrum suitably ride along the outward edges of arms 26 and 27 as the fulcrum is moved between the arms. Movement of the fulcrum in this fashion permits the user to control the stiffness of the device.

An indicator or scale 31 is marked on one arm of the compression section for cooperation with the fulcrum. After the fulcrum is moved to a selected position, an arrow 32 is formed on one edge of fulcrum T-portion 33 for alignment with scale 31. The position of the arrow (or fulcrum) along the scale indicates the degree of tension required to overcome a corresponding resistive force exerted by the device.

In operation, after a tension has been selected and the size of the device has been adjusted, the grips are grasped and moved towards each other for a compressive stroke. Upon release of the grips, the fulcrum coupled with the natural resiliency of the tension arm causes the leg portions to extend to their starting position.

Figure 6:
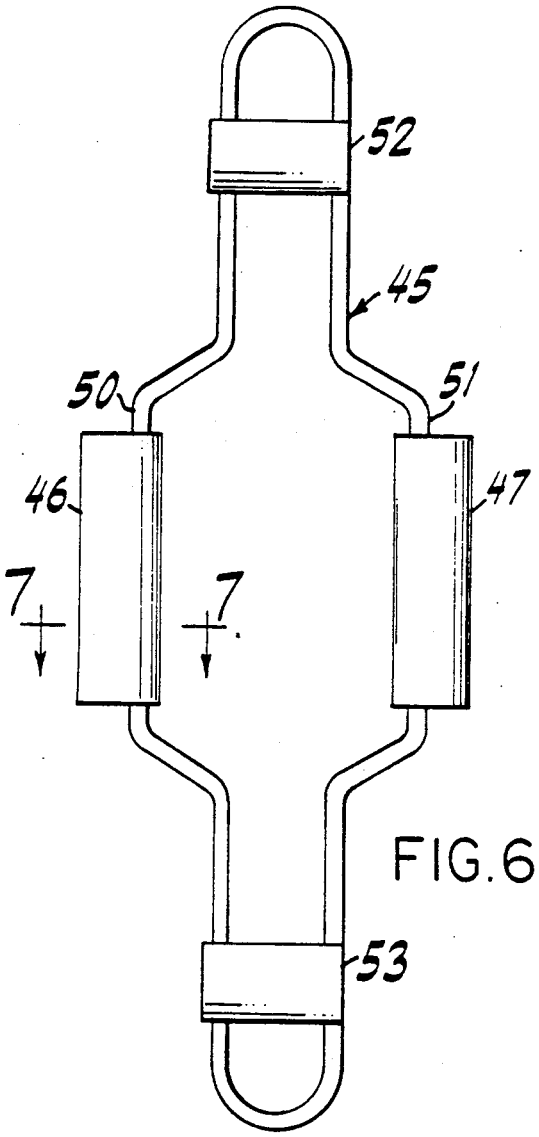
FIG. 6 is a side view of an alternative embodiment of the present invention.

Another embodiment of the present invention is shown in FIG. 6, wherein the grip section end of one of the aforementioned devices is formed end to end with a second such device so that the tension arms 20 now form a closed loop tension arm 45. The parallel arms 50 and 51 mount adjustable grips 46 and 47 like those of the preferred embodiment. However, instead of being removably mounted onto the end portions of the tension arm, each grip has a recess 48 which cooperates with an internal slot 49, as shown in FIG. 9. The recess allows each grip to be opened and snapped onto the sides of tension arm 45. This grip configuration enables each grip to be removed from the closed loop and reversed to vary the distance between the outer edges of the grips and thereby accommodate each hand size.

In addition, a pair of translatable fulcrums 52 and 53 are utilized, one at each end of closed loop 45, to facilitate the exertion of larger resistive forces as well as more precision and variation in the degree of stiffness to be exerted by the device.

Figure 8:
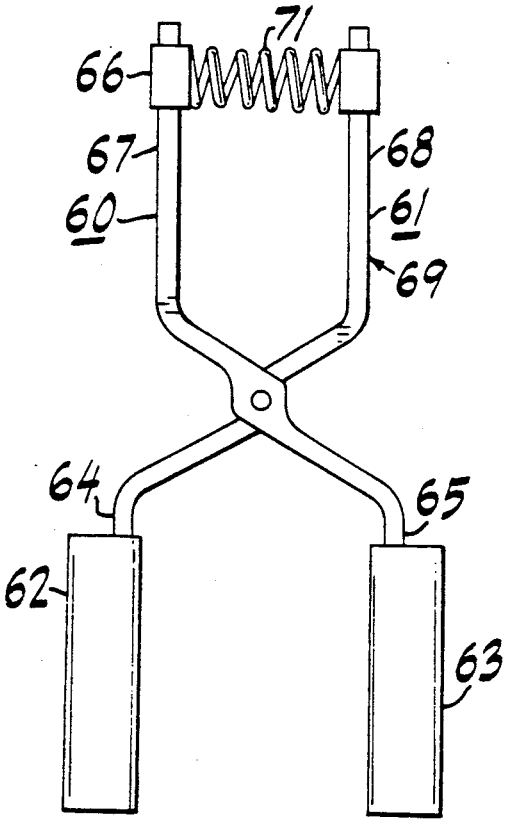
FIG. 8 is a side view of an alternative embodiment of the present invention.

Another alternate embodiment of the present invention is shown in FIG. 8, wherein each S shaped leg portion 60 and 61 has been joined to the other like a scissors rather than being joined at an end of the tension arm. In a similar manner to the device shown in FIG. 1, the grips 62 and 63 are mounted to grip arm sections 64 and 65, respectively, and a translatable fulcrum 66 is mounted between parallel leg portions 67 and 6 of compression section 69. As best seen in FIG. 3, the fulcrum 66 comprises a spring 71 or other suitable resilient apparatus slidably disposed between leg portions 67 and 68 for resisting compressive forces exerted by a hand and subsequently returning the device to a starting position.

Figure 5:
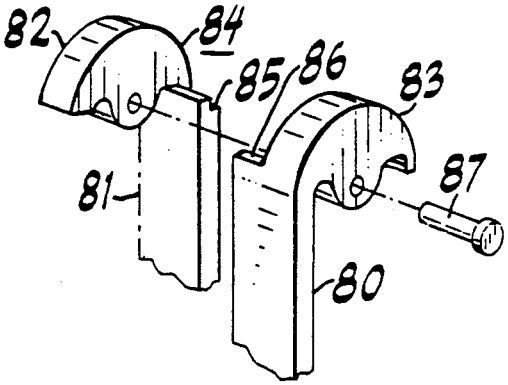
FIG. 5 is an exploded perspective view of the dovetail stop mechanism of FIG. 4.

Referring now to FIG. 4, still another embodiment of the present invention is shown. This embodiment differs from that shown in FIG. 1 in that the S shaped leg portions 80 and 81 are joined at a common end by a hinge 84 and pin 87. As shown in FIGS. 4 and 5, each leg portion has a dovetail 82 and 83 adjacent the hinge and overlapping the other leg portion but on opposing edges. Each leg portion 80 and 81 also includes a recess 85 and 86, respectively, for receiving the dovetail of the other leg portion.

As the grips 88 and 89 are grasped and moved towards one another, the leg portions pivot about hinge 84 and the dovetails disengage from the recesses in each leg portion. Upon release of the grips, the leg portions return to the starting position where the dovetails engage the recesses thereby preventing opposing leg portions from rotating outboard about the hinge.

Figure 10:
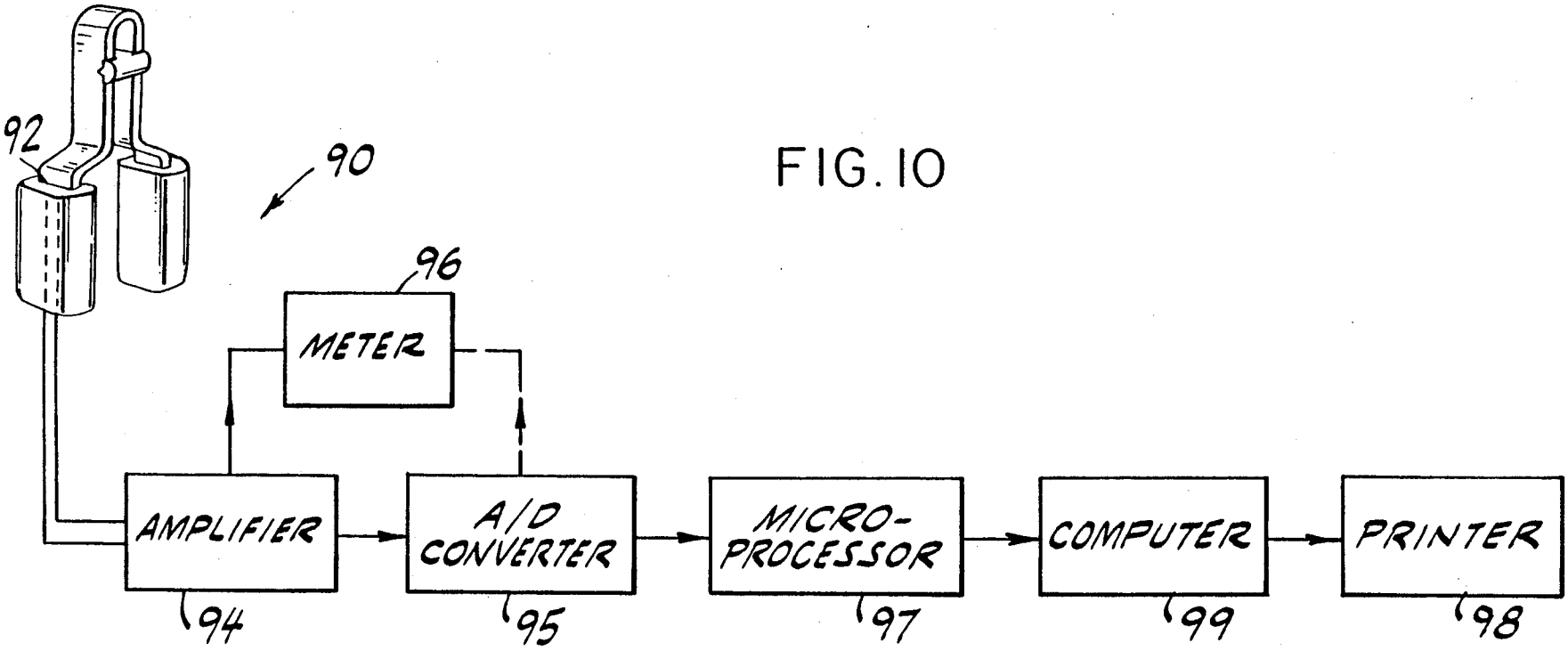
FIG. 10 is a schematic diagram of a system for measuring the strength of a hand.

Another alternate embodiment of the present invention is shown in FIG. 10, wherein the hand exercise device shown in FIG. 1 is connected with a system 90 which measures the compressive forces exerted by a hand and computes the strength of the user's hand. Not only is such a device useful for an exercise program, but also for evaluating progress during physical rehabilitation. In particular, the system is useful for persons recovering from hand surgery, strokes and other problems causing loss of hand strength.

The system 90 includes a sensor 92 attached to the exercise device using electrical wiring 100 or the like. The sensor consists of a strain gauge or other suitable sensing apparatus mounted adjacent to the shoulder of a leg portion and in cooperation with a grip. A load cell, piezoelectric crystal or other load sensing apparatus can also be mounted to translatable fulcrum 30. In particular, sensor 92 generates an electric signal which varies according to the amount of pressure or compressive force exerted by the hand upon the grips. The electric signal is then intensified by an amplifier 94 and displayed numerically on a meter 96 in suitable units such as pounds or newtons. Meter 96 may be of an analog or digital type.

Alternatively, amplifier 94 may be connected to an analog to digital converter 95 enabling the resulting output to be fed to a microprocessor 97 and a computer 99 using a selected algorithm. The use of computer 99 not only permits the computation of hand strength but also the graphic display of the force exerted upon the hand exerciser plotted with respect to time and displacement. In this manner, measurements may be taken and recorded periodically to show a patient's history and rehabilitation progress. The computer may also include a printer 98 for generating hard copies of the graphic display.

The device of the present invention may be constructed of a variety of different materials. However, one should keep in mind when selecting the materials to be used the stresses to which the device will be subjected during ordinary use. For example, although the tension arm and fulcrum have been depicted as being made of a rigid material such as metal, any rigid, semi-rigid or resilient material may be used given consideration to the particular design and intended purpose of the device.

Although the invention has been described in detail in connection with several embodiments, various additional modifications will be readily apparent to those of ordinary skill in the art. Such modifications are within the spirit and scope of the invention which is limited and defined only by the appended claims.

What is claimed is:

1. A device for exercise of a hand and forearm comprising:

a resilient member adapted so as to enable grasping by a hand, said member resisting compressive forces exerted upon grasping by said hand and, upon release, returning to a starting position, means for controlling the stiffness of said member so as to achieve a selected resistive force, and means for adjusting said device so as to accommodate grasping by a hand having a selected size, said resilient member including tension arms joined at a common end and positioned a selected distance from one another for grasping by a hand, said adjusting means including grips, each grip being reversible for accommodating hands of more than one size.

2. The device according to claim 1, wherein each of said grips consists of a resilient material.

3. A device for exercise of a hand and forearm comprising:

a resilient member adapted so as to enable gasping by a hand, said member resisting compressive forces exerted upon grasping by said hand and, upon release, returning to a starting position, means for controlling the stiffness of said member so as to achieve a selected resistive force, and means for adjusting said device so as to accommodate grasping by a hand having a selected size, said resilient member including tension arms joined at a common end and positioned a selected distance from one another for grasping by a hand, said control means including a translatable fulcrum adapted for movement along said tension arms so as to achieve said selected stiffness.

4. The device according to claim 3, wherein at least one of said tension arms includes an indicator associated with said translatable fulcrum, whereupon sliding engagement of said translatable fulcrum a selected distance along said tension arm, said indicator designates said selected stiffness.

5. A system for exercise of a hand and forearm comprising:

a resilient member adapted so as to enable grasping by a hand, said member resisting compressive forces exerted upon grasping by said hand and, upon release, returning to a starting position, means for measuring the compressive forces exerted by said hand, means for controlling the stiffness of said member so as to achieve a selected resistive force, and means for adjusting said device so as to accommodate grasping by a hand having a selected size.

said resilient member including tension arms joined at a common end and positioned a selected distance from one another for grasping by a hand, said adjusting means including grips, each grip being reversible for accommodating hands of more than one size.

6. The device according to claim 5, wherein each of said grips consists of a resilient material.

7. The system according to claim 5, wherein said measuring means includes means for sensing the compressive forces exerted by said hand.

8. The system according to claim 7, wherein said measuring means includes apparatus associated with said sensing means for computing the strength of said hand.

9. The system according to claim 7, wherein said measuring means includes a meter associated with said sensing means for the display of the compressive forces exerted by said hand.

10. A system for exercise of a hand and forearm comprising:

a resilient member adapted so as to enable grasping by a hand, said member resisting compressive forces exerted upon grasping by said hand and, upon release, returning to a starting position, means for measuring the compressive forces exerted by said hand, means for controlling the stiffness of said member so as to achieve a selected resistive force, and means for adjusting said system so as to accommodate grasping by a hand having a selected size.

said resilient member including tension arms joined at a common end and positioned a selected distance from one another for grasping by a hand, said control means including a translatable fulcrum adapted for movement along said tension arms so as to achieve said selected stiffness.

11. The system according to claim 10, wherein at least one of said tension arms includes an indicator associated with said translatable fulcrum, whereupon sliding engagement of said translatable fulcrum a selected distance along said tension arm, said indicator designates said selected stiffness.

* * * * *